US005871292A

United States Patent [19]

Johnson et al.

[11] Patent Number: 5,871,292

[45] Date of Patent: Feb. 16, 1999

[54] COOPERATING MECHANICAL SUB-ASSEMBLIES FOR A DRUM-BASED WIDE FORMAT DIGITAL COLOR PRINT ENGINE

[75] Inventors: Neill Arthur Kelso Johnson, Bloomington; Benjamin Patrick Leonard, Saint Paul; Robert Anthony Laumeyer, Minneapolis, all of Minn.

[73] Assignee: LaserMaster Corporation, Eden Prairie, Minn.

[21] Appl. No.: 711,796

[22] Filed: Sep. 10, 1996

[51] Int. Cl.[6] ..... B41J 19/00; B41J 23/00

[52] U.S. Cl. ..... 400/328; 400/175; 347/50; 347/37

[58] Field of Search ..... 347/30, 33, 328, 347/37, 39, 58, 50; 400/328, 716, 691, 352, 175, 692

[56] References Cited

U.S. PATENT DOCUMENTS

| | | | |
|---|---|---|---|
| 4,538,160 | 8/1985 | Uchiyama | 400/328 |
| 4,613,245 | 9/1986 | Ikeda et al. | 400/328 |
| 4,626,117 | 12/1986 | Dumusc | 400/716 |
| 5,026,186 | 6/1991 | Hasegawa et al. | 400/691 |
| 5,212,502 | 5/1993 | Bowling | 400/175 |
| 5,237,338 | 8/1993 | Stephenson | 347/223 |
| 5,486,854 | 1/1996 | Uychida | 347/30 |
| 5,644,347 | 7/1997 | Schwiebert et al. | 347/33 |

*Primary Examiner*—John S. Hilten
*Attorney, Agent, or Firm*—Paul J. McDowall

[57] ABSTRACT

This invention relates to an improved wide format color digital print engine, and in particular to a cooperating group of print engine sub-assemblies comprising a sealable enclosure defining electronics and printing sub-spaces within the enclosure and supporting two critical alignment plates which alone control alignment of all major sub-assemblies of the print engine and which provide accurate attachment points for a carriage drive and rail sub-assembly, a motor and drum mounted to rotate within a printing bay, and mounting points for a service station for cleaning and storing a plurality of marking elements associated with replaceable ink emitting cartridges. The subassemblies cooperate to generate high quality colored images as a drum-based large format digital ink jet print engine. In particular, the present invention provides a highly manufacturable print engine benefiting from a discrete few controlled mounting locations so that accurate mounting of the cooperating sub-assemblies allow a very stable carriage assembly for driving said carriage laterally with respect to a printing medium coupled to the exterior of a drum spinning within a printing bay and controlled by print head electronics utilizing a timing sequence from the rotating drum and lead screw for driving the carriage assembly.

6 Claims, 18 Drawing Sheets

COOPERATING MECHANICAL SUB-ASSEMBLIES FOR A DRUM-BASED WIDE FORMAT DIGITAL COLOR PRINT ENGINE

FIELD OF THE INVENTION

This invention relates to an improved wide format color digital print engine, and in particular to a cooperating group of print engine sub-assemblies comprising a sealable enclosure defining electronics and printing sub-spaces within the enclosure and supporting two critical alignment plates which alone control alignment of all major sub-assemblies of the print engine and which provide accurate attachment points for a carriage drive and rail sub-assembly, a motor and drum mounted to rotate within a printing bay, and mounting points for a service station for cleaning and storing a plurality of marking elements associated with replaceable ink emitting cartridges. The subassemblies cooperate to generate high quality colored images as a drum-based large format digital ink jet print engine. In particular, the present invention provides a highly manufacturable print engine benefiting from a discrete few controlled mounting locations so that accurate mounting of the cooperating sub-assemblies allow a very stable carriage assembly for driving said carriage laterally with respect to a printing medium coupled to the exterior of a drum spinning within a printing bay and controlled by print head electronics utilizing a timing sequence from the rotating drum and lead screw for driving the carriage assembly. The present invention finds use in the digital printing and imaging industry where successful repeatable printing requires precise placement of dots on a printing material including paper, vinyl, film, wax-based, or other substrates that typically include emulsion coatings thereon, to promote consistent interaction with printing media marking materials such as ink, toner, or various printing compounds.

BACKGROUND OF THE INVENTION

The present invention relates to an improved apparatus for supporting and driving a print head carriage across a printing media so that dots may be placed thereon to form a visual image to a human viewer. Prior art mechanisms for driving a print carriage typically utilize a belt and pulley actuated mechanism or helical gear attached to the print carriage. As digital print head accuracy and acceptable manufacturing tolerance specifications have improved, a limitation in field-replaceable precision mechanical driving mechanisms for such print heads has arisen.

Prior art print head rail members for large format print engines further encounter limitations due simply to the length and mass of a typical rail and carriage drive assembly and control difficulties related to precisely controlling all the specifications and tolerances during manufacturing and installation. A known phenomena described as "tolerance stacking" contributes a significant component of error in an assembly process wherein at least two precision machining events occur at differing times on the same assembly. In relation to a carriage assembly for a large format print engine, such tolerance stacking occurs at a number of discrete points of manufacture. For example, a carriage typically precisely supports at least one, and oftentimes several, print heads, a portion of the circuitry for such print heads, and attachment means for driving the carriage assembly upon a guideway or track in a highly controlled manner. Thus, machining portions of subassemblies to arrive at an exact location of the print head(s) relative to: other print head(s), the printing medium, and the rail assembly can all contribute positional error relative to a design criteria possessing rigorous tolerance specifications.

Additional problems with prior ink jet head configurations involve the mounting of the print head for accurate placement and movement across the printed image. The rail structure for the print head must adequately support the print head not only over the entire printed image, but also for any cleaning, maintenance and other auxiliary functions of the print head. It is common to provide a zone, away from the printing medium within which to "park" the print head to perform auxiliary "service" functions, this zone is commonly known as a service station. These auxiliary functions may include manipulating the carriage, certain calibration functions, cleaning and capping of the print heads. To accommodate the park zone, the support system, or rails, must support the head over a distance greater than the width of the printing medium. For example, printers handing printing medium about 11 inches wide (which accommodates the length of standard 8½×11 paper) may have rails about 17 inches long.

Accurate placement and movement of the print head becomes more and more difficult as the length of the print scan (i.e., the width of the image) increases. Most prior ink jet printers over about 17 inches wide employ either a two-rail structure, or a single-rail and outrigger structure, for head carriage X-directional travel. Both of these techniques provide two separate and independently adjustable support points for the carriage. Multiple support systems were used on wide format printers because it was believed that a single rail could not provide adequate support and stability for the print head over a large distance. Multiple support systems were utilized to provide a wider support base for the print head and carriage to lessen the effect of any stability problems, as well as to provide additional strength to lessen rail flexing problems. Vibration problems may occur if the print head undergoes movement with respect to the rail structure. The print head may slightly rotate or shake about an axis parallel to the rails, causing the print head placement with regard to the paper surface to be inaccurate. Alternatively, the print head may slightly rotate or shake from side to side on the rails, perhaps due to the direction of print head travel.

Dual support systems are not altogether feasible for graphics quality, large format printing because it is difficult to maintain parallelism of the supports across the entire width of the large format media. More particularly, each support introduces positional error, resulting in non-parallel guide paths for the carriage. Further, prior art two-rail systems employ a pair of circular rails, with the print head mounted on a carriage which is in turn mounted on the rails. The carriage is generally supported by circular sets of ball bearings wrapped around each of the circular rails. Non-parallelism of the rails introduces vibration through the ball bearings to the carriage, often causing instantaneous horizontal velocity errors. If the supports are not parallel, the rollers on the carriage will bind or have excess freedom at particular locations along the rails, and cause further stability and vibration problems. If bending of the rails occurs and the railings are not maintained completely straight, errors occur in positioning the print head. Additional problems occur due to the space that the rails take up, interfering with the transfer of electronics and ink from the printer housing to the print head. It will be appreciated that these problems are magnified as the length of the rail or rails becomes greater, as in large-format printing. Accordingly, a print head configuration is desired which will avoid these various problems.

One mechanism for cleaning the print head involves wiping the print head with blotter paper as described in U.S. Pat. No. 4,928,120 to Spehrley, Jr., et al. The Spehrley, Jr. blotter is provided in a replaceable plastic module. The Spehrley Jr. blotter has a top roller for pressing against the print jet orifices and a bottom roller for pressing against the bottom face of the print head when they are being wiped. While this blotter works acceptably, a less expensive method and apparatus for blotting is desired.

Furthermore, such prior art carriage and drive systems typically are not designed for in-field replacement with minimum personnel and requiring a minimum amount of service time. In fact, due to the obvious competing design objectives of mechanical positional accuracy and field replacement convenience, the inventors are aware of only one other such rail system offering similar design benefits. The inventors refer to U.S. Pat. No. 5,592,202, and titled "Ink Jet Print Head Rail Assembly" which Patent is commonly assigned with the present invention to LaserMaster Corporation of Eden Prairie, Minn. 55344. In the application cited, a single rail pivotably attaches to at least one end of a print engine chassis so that the carriage riding thereon may be removed for field service and replacement. The benefits of such a system relate to diminished down-time, reduced required service, and efficient repairs, thereby reducing the overall cost of ownership involved in operating one or more large format digital print engines.

Prior art digital printing systems typically operate by incrementally moving or "stepping" a print medium transverse to a stationary or reciprocating imaging print head. The print head frequently includes a plurality of discrete imaging elements suitably arranged in a pattern, one or more linear arrays disposed perpendicular to the direction of movement of the printing substrate, or as a single marking point element. The net result is that discrete dots are placed on precise locations on the printing media so that a pleasing visual image is rendered upon the printing media. A picture element or pixel generally refers to a coverage area defined by this stepping resolution in the "vertical" or y-direction relative to a print head fixed in the x-direction, and the number of discrete marks producible by the thermal print head in the "horizontal" or x-direction. These pixels must be controlled very carefully to impart desired quality of the image, and the physical and chemical interaction between the marking material and the printing media and the environmental conditions under which the marking material is deposited upon the printing media all contribute to the quality of the actual image rendered.

Most digital print engines that typically use one or more of a subset of the four subtractive primary colors: cyan, yellow, magenta and black ("CYMK") and rely upon color blending of these four ink colors to achieve accurate representations of desired color(s). Upon combining ink colors at a given pixel that a particular color combination can be formed by having multiple ink colors at a particular pixel location, either in a dot-on-dot or a dot-next-to-dot configuration. In sum, digital printing processes involve placing a number of tiny dots onto particular locations on a printing medium. Any number of these small dots, when viewed some distance away from a printing medium such as film or paper, are perceived as a continuous-tone visual image. Thus, it can be appreciated that even slight variance in the actual positional location of the ink dots can significantly effect the overall visual impression created by the printed image. In one subset of digital printing technology, aqueous ink is expelled from a plurality of ink jet nozzles to form dots on the printing media. This is known as "ink jet" printing and its popularity and the innovation related thereto have greatly increased the accuracy and therefore the photorealistic quality of the images printed, while at the same time attempting to lower the costs of ownership of large format full color digital print engines. While the types and numbers of inks, and ink jet cartridges, usable with such printers have increased thereby increasing the complexity of controlling interaction among the inks, cartridges, and printing medium, reduced costs of ownership and ease of serviceability continue to drive a large amount of innovation in this field of endeavor. Thus, a continued need exists in the art for low cost and at the same time technically advanced, highly accurate means of performing wide format color digital ink jet printing.

SUMMARY OF THE INVENTION

The reader is encouraged to cross reference and review the present document with a number of U.S. patent applications, filed on even date and commonly assigned to LaserMaster Corporation of Eden Prairie, Minn., USA—the contents of each such application are hereby incorporated by reference in their entirety herein, these applications possess U.S. Ser. Nos. 08/711,992; 08/709,804; 08/709,803; and 08/711,815 and are titled "Calibration and Registration Compensation Method for Manufacturing a Drum-based Print Engine," "Method and Apparatus for Manufacturability of a Low Cost Printing Drum," "Method and Apparatus for Compensating for Faulty Ink Emitting Elements in a Drum-based Print Engine" and "Method of Selecting an Ink Set of an Ink Jet Printer," respectively. Furthermore, applicant herein incorporates U.S. Pat. No. 5,369,429 titled "Continuous Ink Refill System for Disposable Ink Jet Cartridges Having a Predetermined Ink Capacity" and U.S. Pat. No. 5,469,201 directed to a guideway for a continuous ink refill system, both of which are commonly assigned to the present assignee, LaserMaster Corporation.

The present invention relates to a low cost, large format print engine featuring field replaceable subassemblies such as: a carriage and rail assembly, a drum assembly, rotary encoder device for monitoring drum rotation, two electronics subassemblies—a first for operating the printing system software (disposed in an electronics bay), and a second for handling all print related image data management and printing operations (disposed on the carriage assembly), and a service station subassembly for cleaning and maintaining a plurality of ink jet cartridges operating in a large format ink jet print engine. The print engine of the present invention achieves the goals as well as the following so that relatively complex large format digital color electronic printers may be reliably and simply fabricated, operated, and serviced and thereby producible in high volume at reduced cost making ownership of such machines less expensive overall. Some of the key advantage of a print engine taught herein include: no critical alignments and no field alignment activity required (other than cartridge replacement), one touch go/no-go user interface, ink—designed for easy swapping between different ink sets (for example: CMYK—dye-based aqueous, pigment-based aqueous, and inks of varying densities), 100 Mbs data rate (preferably including "VideoNet" protocol support with a "Standard" Fast Ethernet hub usable as a VideoNet hub), all shielded cables, no preventative maintenance necessary by the end-user, all subassemblies must be field replaceable in under 30 minutes (including disassembly & assembly) by 1 person, only subassemblies may be replaced in field, not components within subassemblies, all metric fasteners and all necessary tools must be generally available to each end-user.

The lack of critical alignments deserves further mention, in that the inventors have discovered a pair of complementary critical alignment plates that are virtually impervious to errors during manufacture and which posses extremely robust behavior in almost every orientation. In fact the two critical plates of the present invention must practically be physically bent, or grossly out of relatively parallel alignment before any of the sub-assemblies of the present invention are affected. Thus, the critical alignment plates can handle a great deal of chassis movement without effects on the head height relative to the print medium. The alignment plates thus offer an extremely forgiving initial assembly thereby helping to reduce costs of manufacture of a print engine utilizing alignment plates of the present invention.

Special vibration damping mounting feet are adjustable so that the bulk ink delivery system preferably used with the present invention will reliably deliver ink, per the operating conditions required for uninterrupted delivery of ink from a remote ink reservoir to an ink jet cartridge. Such adjustment will allow the print engine enclosure to stand on an non-level floor or table and be adjusted so that each lateral end of the print engine is properly oriented.

The present invention may be performed with most types of large format digital print head technologies since the characteristics of the print head are more or less independent of the manner in which a carriage for conveying a print head or heads across a print media to create a large format digital image. Thus, the present invention encompasses a carriage assembly which supports the print heads in close proximity to a print medium and slideably couples to two axial support rails while an axial helical lead screw member engages the carriage assembly to reliably control the transverse motion of the carriage relative to the printing medium.

In a preferred embodiment, the carriage slideably contacts only three points on two support rails, and is not supported but is rather only driven via engagement at a single drive location by a two start helical lead screw for propelling the carriage one half inch for every unit turn of the lead screw. Furthermore, in this embodiment, the drive location is disposed at a center of resistance of the entire [print-head-loaded] carriage assembly and all the print head drive electronics reside upon a circuit board disposed intermediate two banks of print heads coupled to opposing lateral sides of the carriage.

The following drawing is representative as preferred embodiment of the present invention and as such should be viewed as illustrative and not limiting to any particular embodiment of the invention, nor is the drawing representative of the relative scale of the features depicted therein.

BRIEF DESCRIPTION OF THE DRAWINGS

FIG. 1B is a similar view of the same critical alignment plate and select dimensions of one embodiment of the usable with the present invention.

DETAILED DESCRIPTION OF THE PREFERRED EMBODIMENTS

Figure 1A:
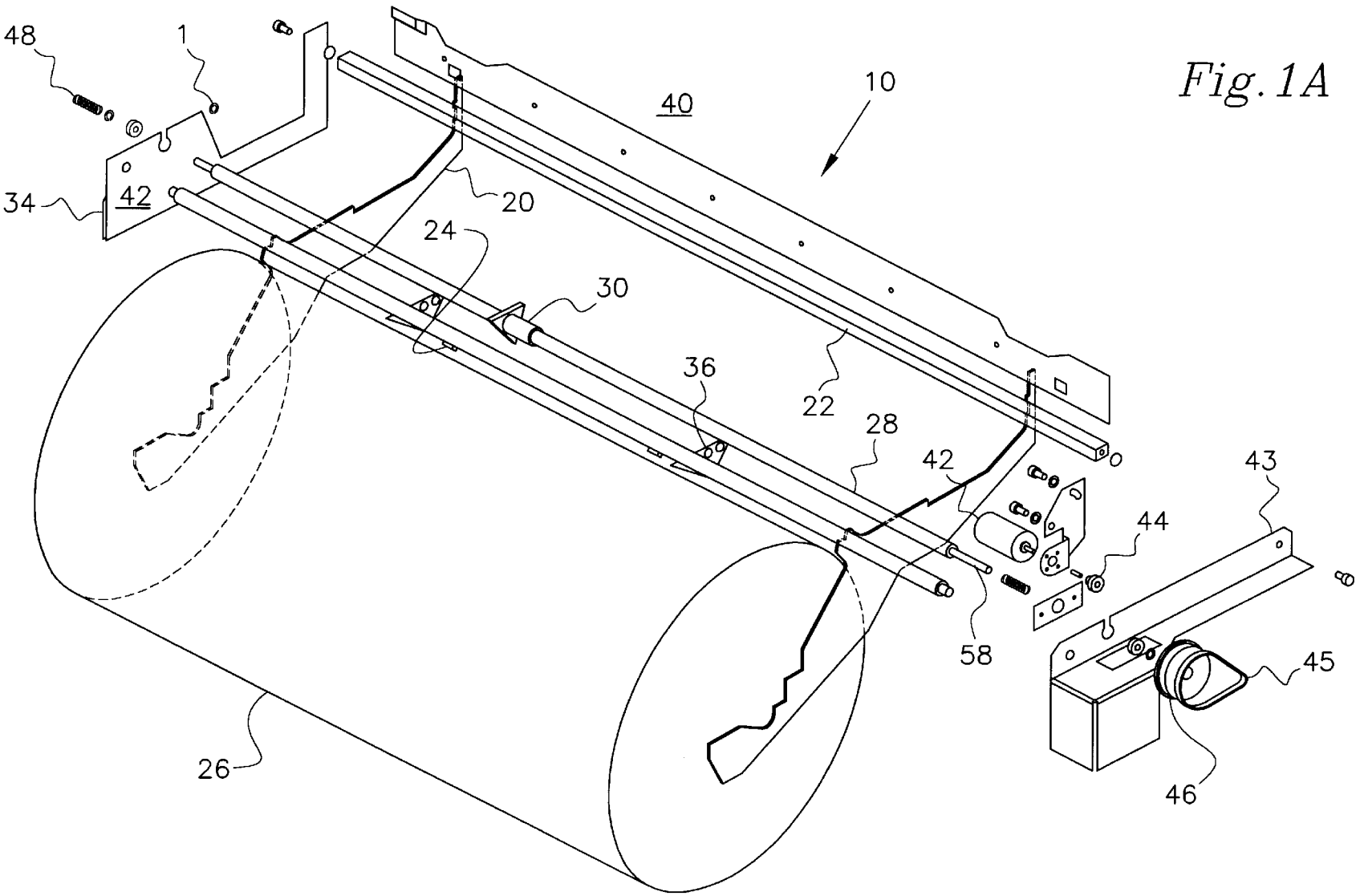
FIG. 1A is an exploded perspective view of a supporting and drive assembly for a carriage usable with the present invention.
Figure 1B:
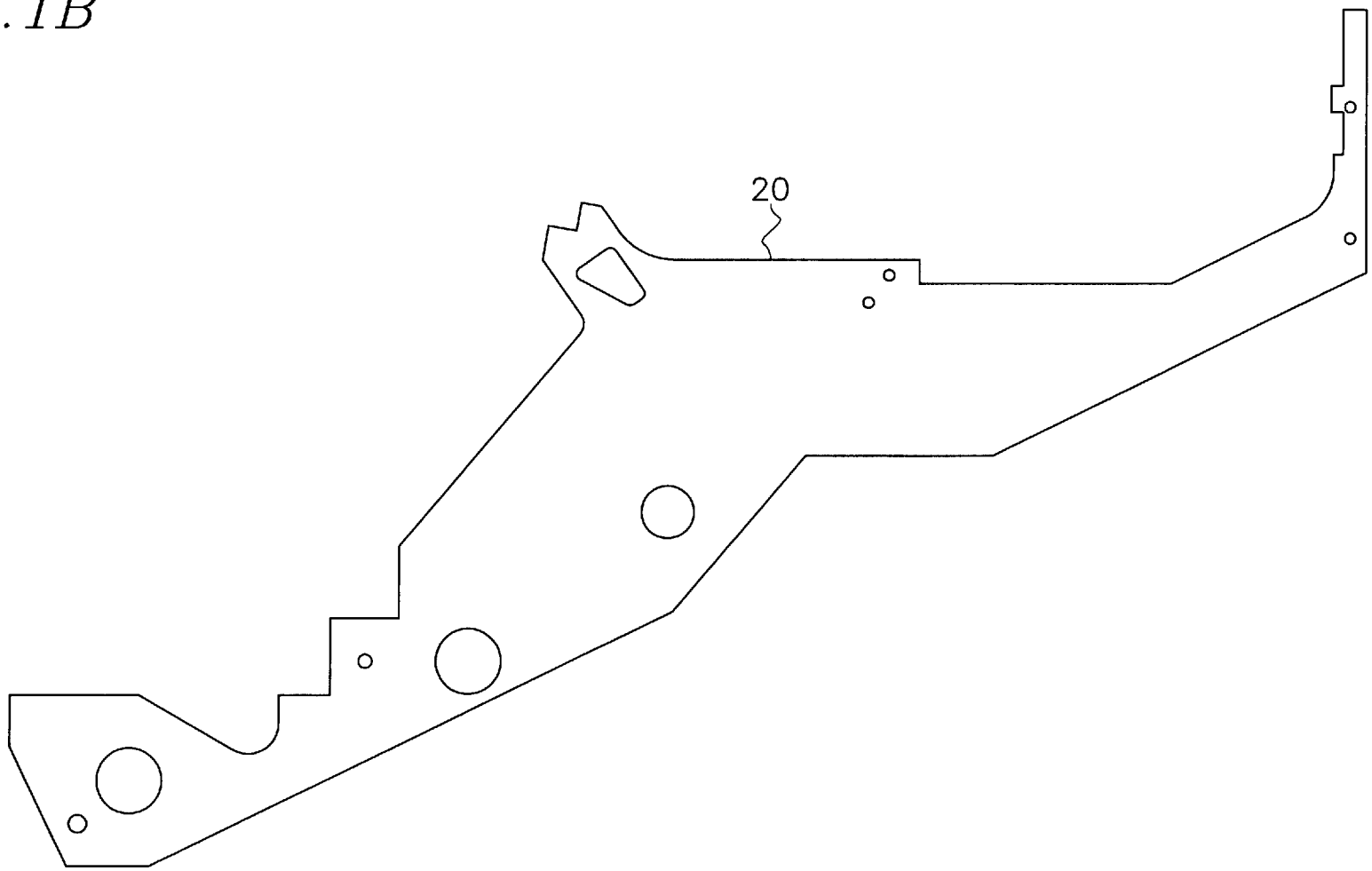
FIG. 1B is an elevational side view of a illustration of a critical alignment plate and select dimensions of one embodiment the present invention.
Figure 12:
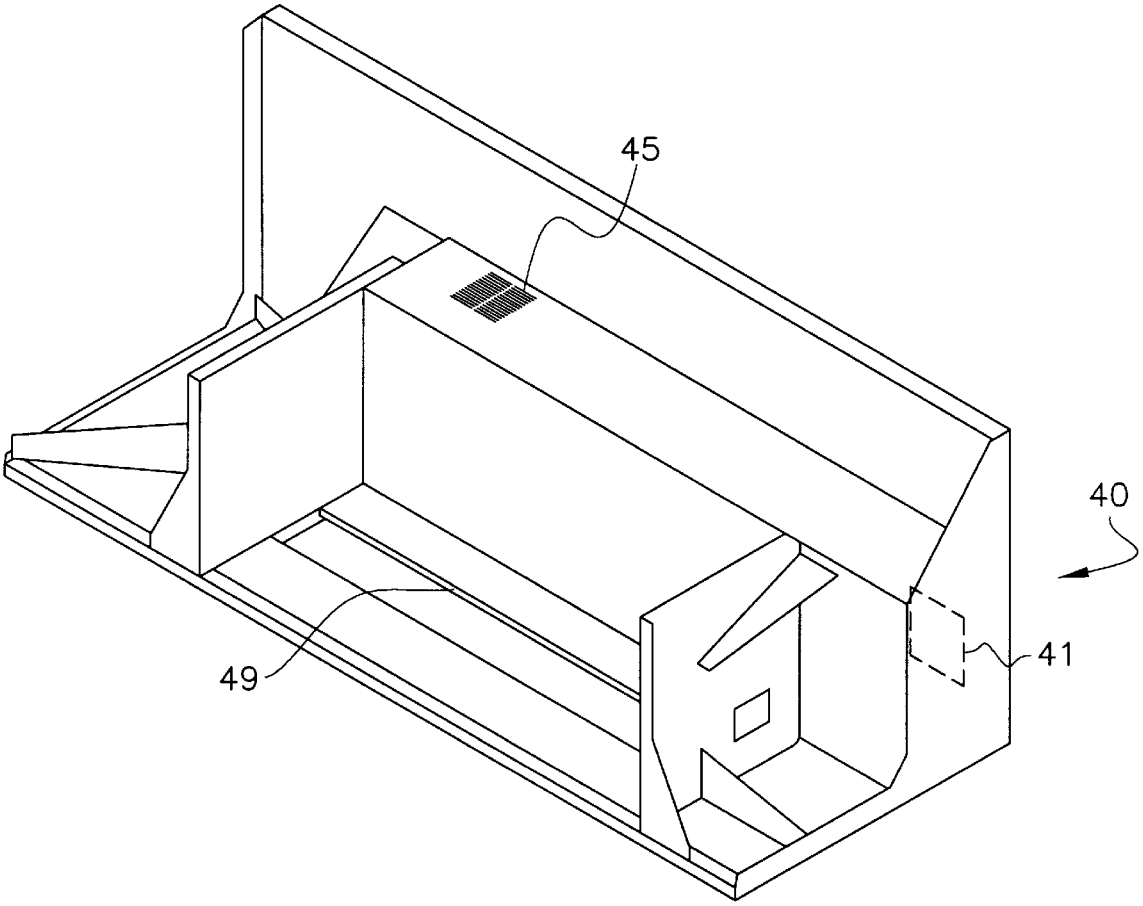
FIG. 12 is perspective view of an print engine enclosure (absent its cover member) usable with the present invention with internal partitions subdividing the interior space into separate electronics and printing bays.
Figure 13:
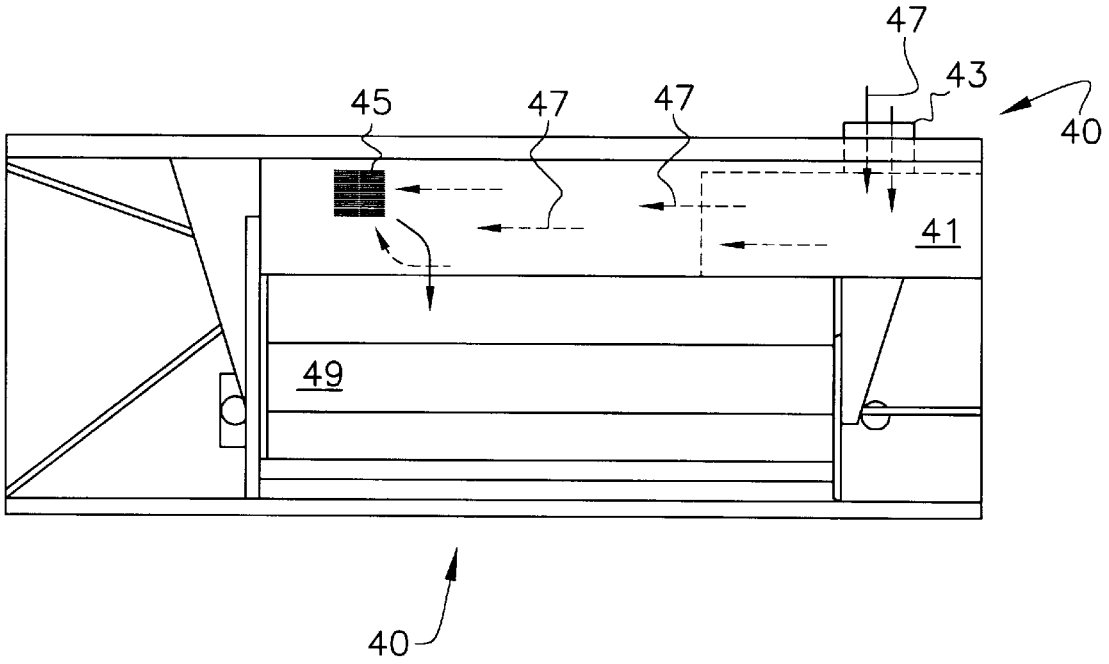
FIG. 13 is a plan view of the enclosure of FIG. 12.
Figure 14A:
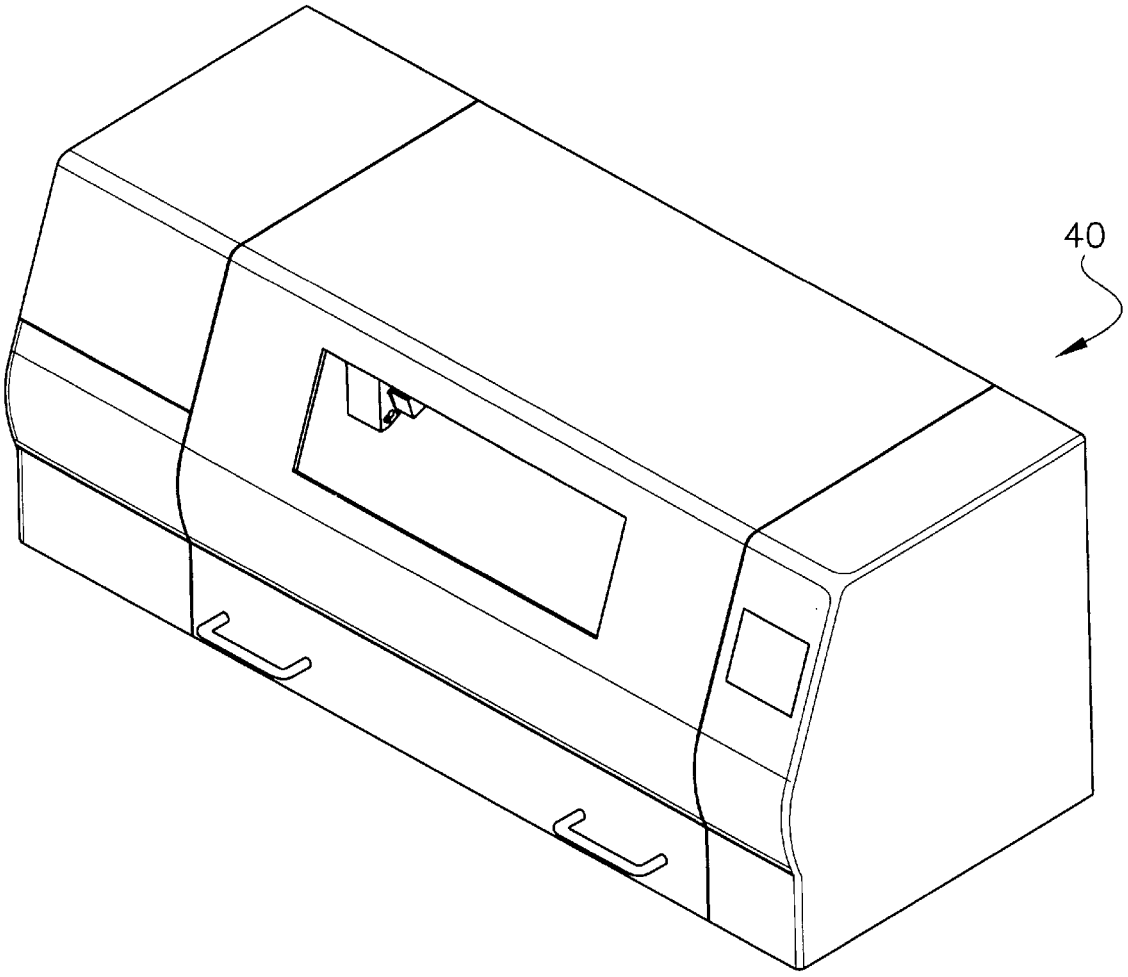
FIGS. 14A and 14B depict perspective views of the enclosure of the print engine of the present invention in a closed and open configuration, respectivley.
Figure 14B:
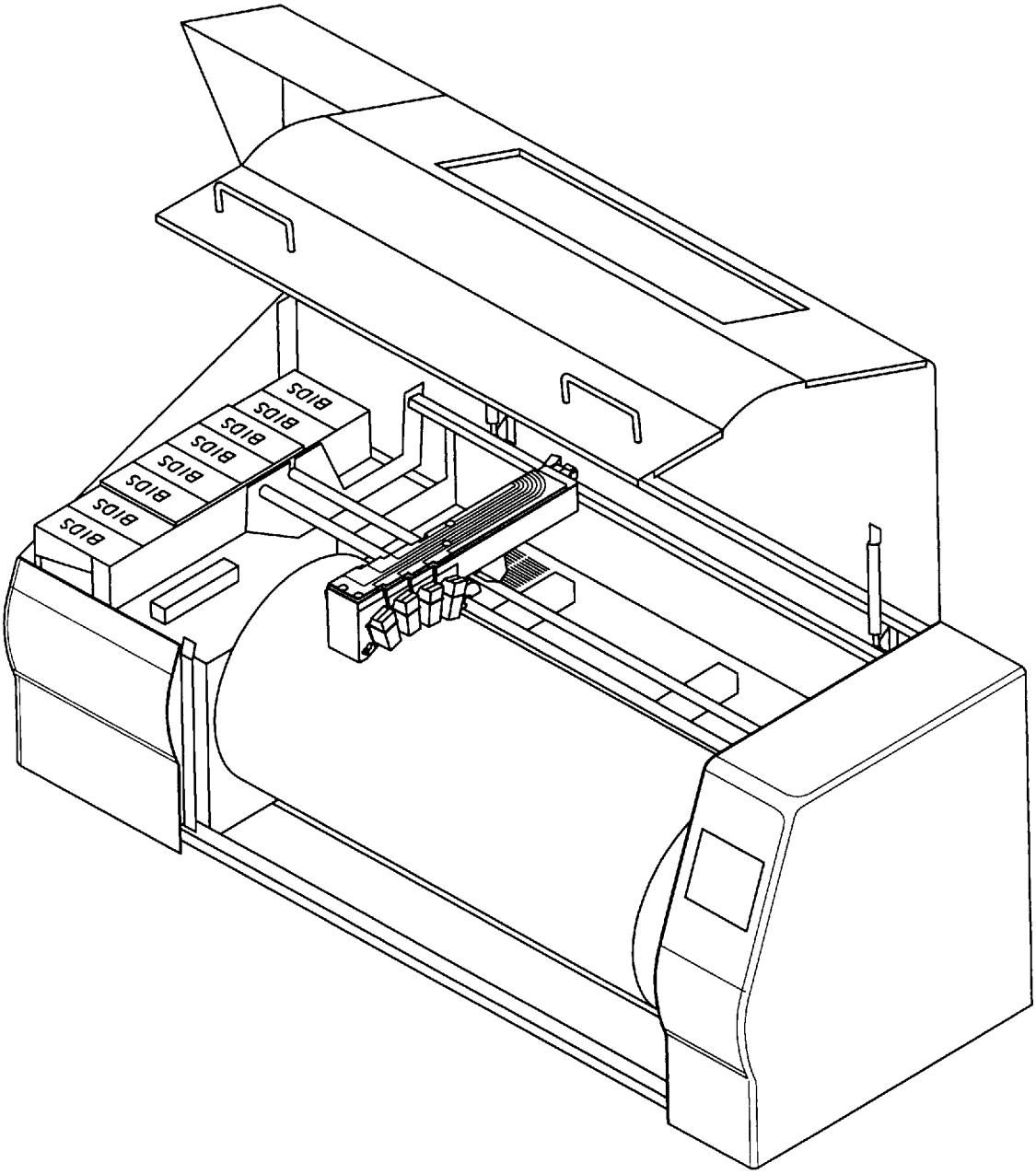
Figure 15:
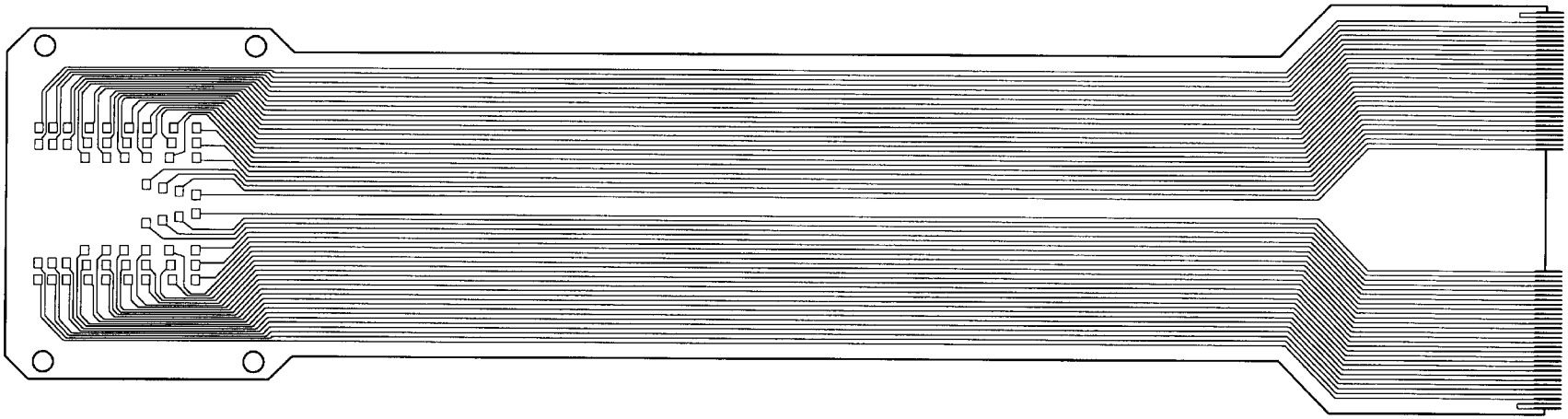
FIG. 15 is a plan view of a flex cable used in a preferred embodiment of the present invention.

An apparatus for reliably and precisely propelling a print carriage along print rails proximate a rotating drum thus forming a low cost, field replaceable apparatus is disclosed and taught herein. Referring to FIG. 1 depicting key elements of the rail and carriage drive assembly 10 of the present invention as typically disposed within suitable print engine chassis housing 40 (shown only partially in FIG. 1, but see FIGS. 12–14) two critical alignment support plates 20 (one shown in FIG. 1, see FIGS. 1A and 1B for further critical dimensional detail) oriented at either end of rail assembly 10 and mechanically coupled to only the components whose alignment relative to one another is critical to print operations; namely, bar rail 22, shaft rail 24, and drum 26 (in ghost in FIG. 1). Lead drive screw 28 engages linear actuator 30 which is preferably an anti-backlash lead screw nut, so that as lead screw 28 rotates, the linear actuator 30 propels along the axis of lead screw 28 in proportion to the rate of rotation of lead screw 28. Linear actuator 30 preferably self lubricates and requires no maintenance whatsoever during its intended service life. Lead screw 28 preferably comprises a two start, or dual thread path, lead screw, pitched relative to vertical such that the linear actuator 30 travels one half inch in an axial direction for every complete rotation of the lead screw 28. Lead screw 28 furthermore is sized to appropriately handle the drive load of the carriage assembly 32 (shown in FIGS. 3–7) such that in one embodiment the diameter of lead screw 28 is three quarters of an inch (¾"). The reason for this choice of diameter relates to the fact that encountering a natural frequency during driving of a lead screw will cause many vibration errors detrimental to quality digital printing.

Bar rail 22 preferably slideably couples at a single location to a distal end of a carriage assembly 32, where a low friction material contacts the polished exterior surface of bar rail 22. The carriage assembly 32 similarly contacts at least two locations of the shaft rail 24 so that a stable three-point support orientation which retains the carriage assembly 32 in a stable, but not over-constrained, slideably secure manner. Lead screw 28 is preferably disposed at a center of resistance of the carriage assembly with respect to the aggregate components of drag induced by the sliding action of the carriage 32 at bar rail 22 and shaft rail 24. Thus promoting an evenly distributed propelling force that inherently reduces jitter and other oscillation of the carriage during printing operations.

Carriage assembly 32 mechanically couples to shaft rail 24 around a majority portion the circumference of cylindrical shaft rail 24 such that the carriage assembly is disengageable from shaft rail 24 by sliding the bearing axially outward and lifting the carriage assembly from its supported position on the rail(s). Carriage assembly furthermore is formed so that the distal end of the carriage assembly firmly abuts a surface of the bar rail in a face to face orientation along a surface of a low coefficient of friction material such as Rulon, which naturally translates with minimal resistance on the material used to construct bar rail 22.

At each end of lead screw 28 where it connects to ancillary supports 42,43 ballast 34 can be added to counteract the naturally sagging of the that occurs in a length of periodically supported rail, such as used in the present invention. Thus, even though the shaft rail 24 is supported upon the two critical alignment support plates 20 and at approximately two additional locations upon adjustable bracket supports 36, the ballast 34 operates to eliminate sagging (during initial fabrication only) and maintain shaft rail 22 straight and parallel to bar rail 24, which is supported along a majority of its length directly upon a support plate rigidly fastened to the rear of the enclosure 40. Lead screw 28 furthermore preferably is spring biased at both ends 48,58 to help ensure uniform and reproducible motion of actuator 30 for every repetition of axial movement of actuator 30, and therefore, to a large degree carriage assembly 32.

Figure 2:
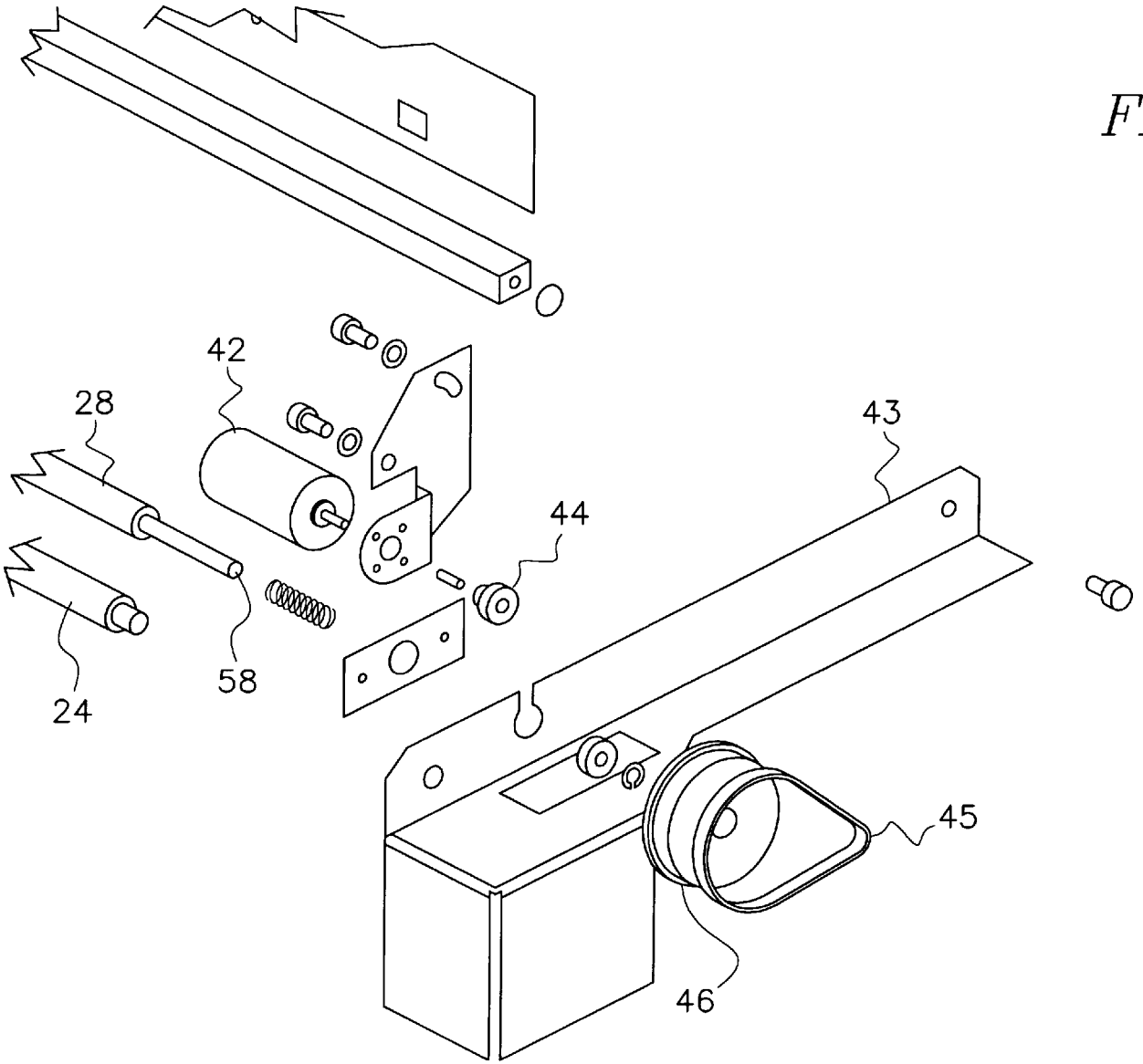
FIG. 2 is an exploded perspective view of an embodiment of a carriage drive subassembly usable with the present invention.

Now referring to FIG. 2, depicting a drive mechanism for lead screw 28 consisting of a low torque motor 41, which must ultimately move the carriage assembly 32 which itself requires a minimum of approximately 8 in/ounces of torque to move the carriage assembly, driving a timing belt and pulley 44 coupled to a spring tensioned timing belt 45 further coupled to gear 46, spaced apart from pulley 44, which is in turn coupled to an end 48 of lead screw 28. Low torque motor 42 is electrically coupled to suitable motor control circuitry 48 to drive the pulleys 44,46 and therefore lead screw 28, precisely during printing operations and periodic service station visits as described elsewhere herein. Basically, a service station as disclosed and enabled herein operates to clean and maintain the print heads intermittently during sustained print operations and during temporary storage, for example, overnight. Notably the service station subassembly also mechanically releasably couples directly to critical alignment supports 20 so that the relative parallel alignment among the drum surface axis (and therefore surface), the bar rail 22, the shaft rail 24, the carriage assembly 32, and the service station (not shown) remains intact. The carriage assembly 32 meets lead screw 28 at interface 29 which receives actuator 30 and shaft rail 24 at interface 25.

Figure 3:
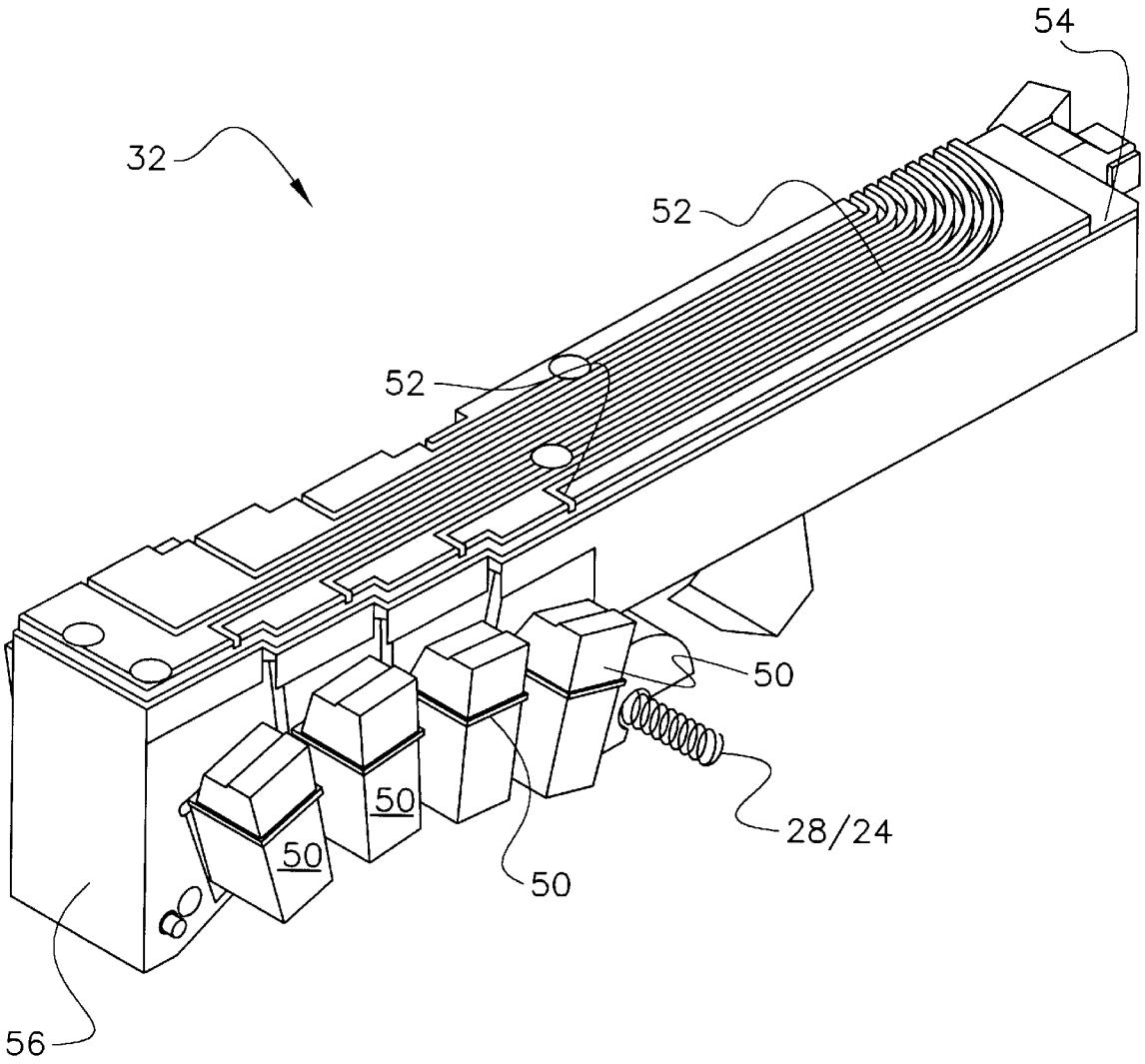
FIG. 3 is a perspective view of an embodiment of a carriage assembly for releasably retaining eight ink jet cartridges in close proximity to a printing medium attached to a rotating drum member.
Figure 4A:
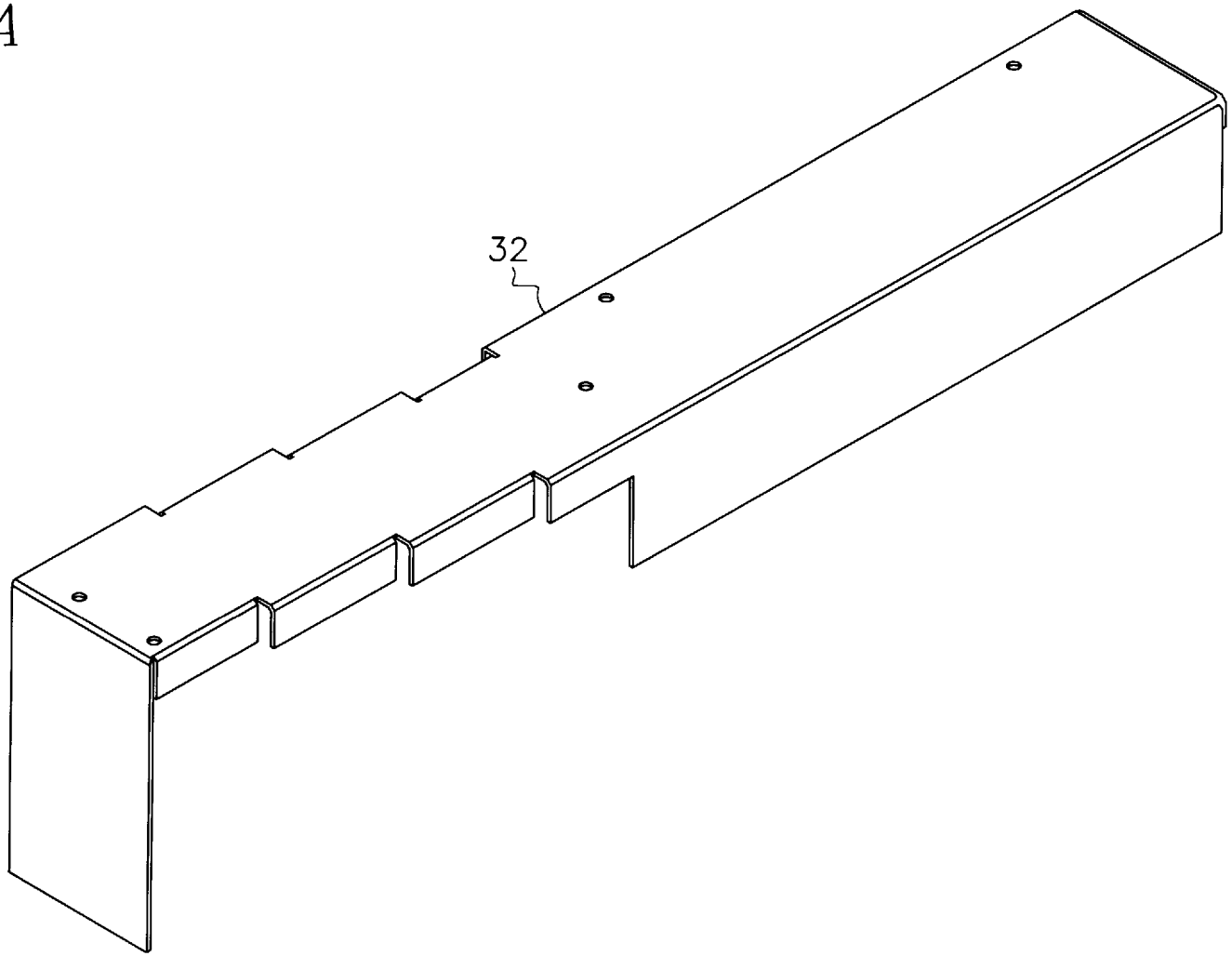
FIG. 4A is a perspective view.
Figure 4B:
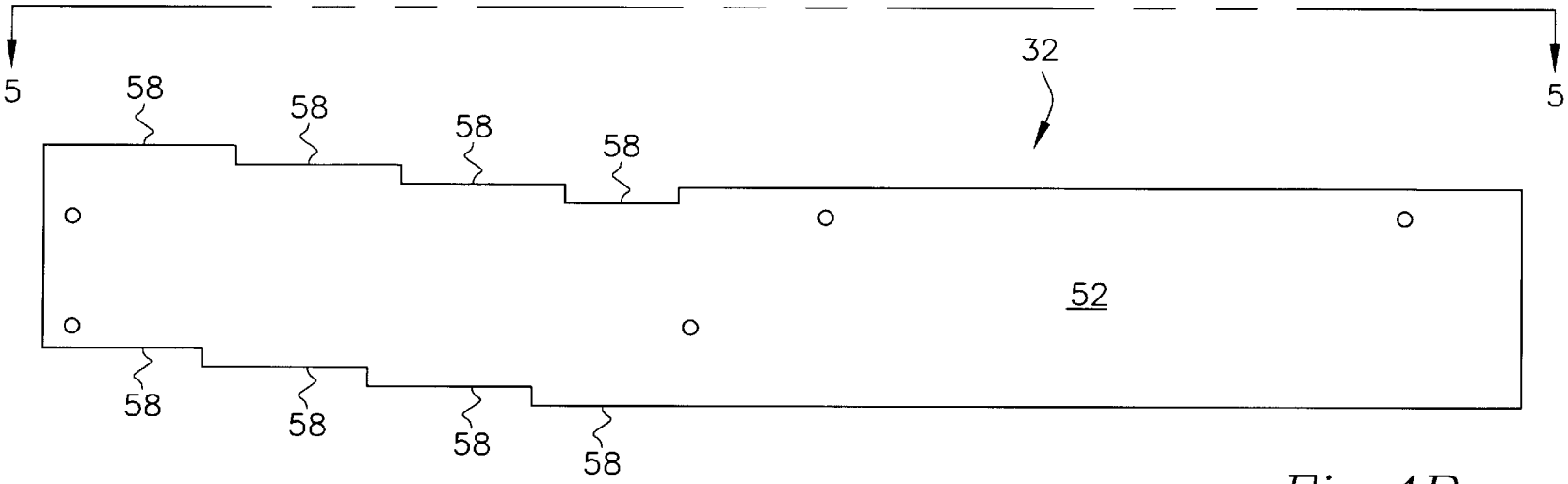
FIG. 4B is a plan view.
Figure 4C:
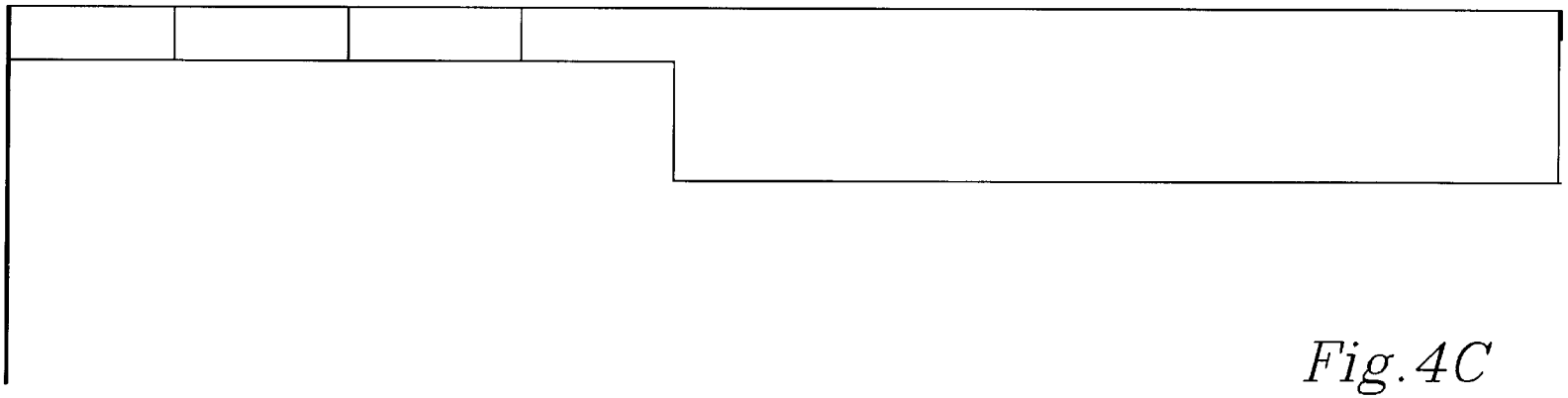
FIG. 4C is an elevational side view of the embodiment of a carriage assembly depicted in FIG. 3.
Figure 5:
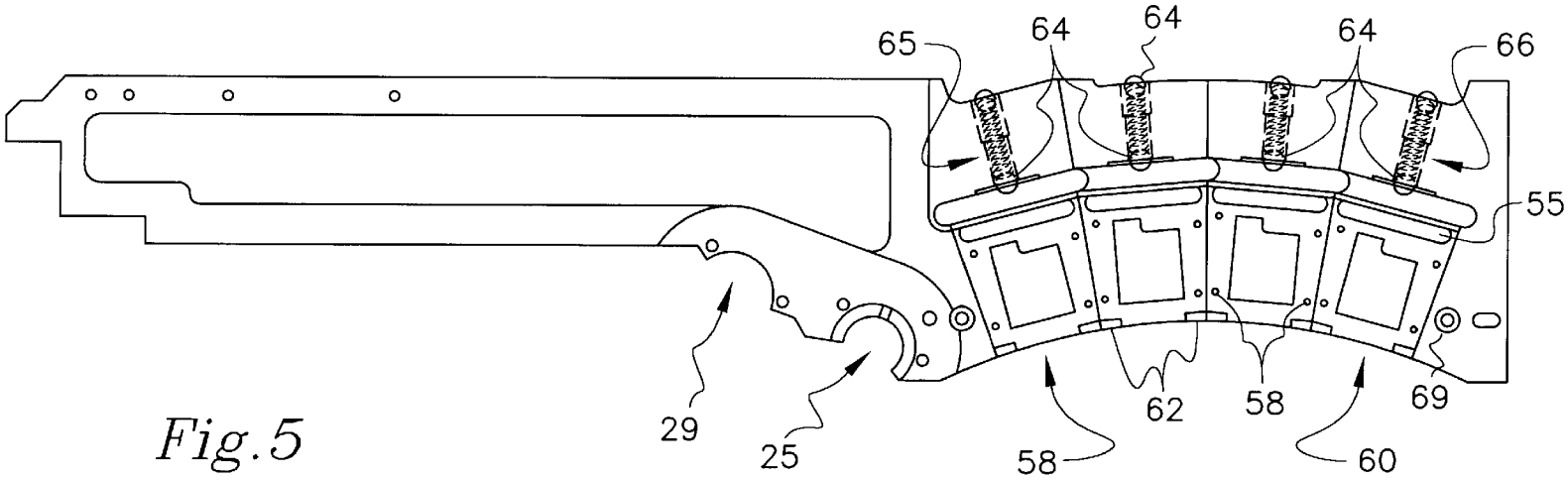
FIG. 5 is an elevational side view in cross-section of a lateral side of an embodiment of the carriage assembly depicted in FIGS. 3 and 4, mainly illustrating the relative radial orientation of four print cartridges coupled thereto during printing operations.

Referring to FIG. 3, depicting a portion of the carriage assembly 32, including print heads 50 and ink tubing receiving grooves 52 fastened into carriage top cap 54, and a lateral end cap 56 sealing the end of carriage assembly 32. As can be seen in FIG. 4, a plan view of print head 50 mounting surfaces 58, the surfaces 58 are arranged in stepped fashion axially and laterally. Preferably, the steps are sized to ensure that no two print heads 50 operate to print a common print swath. Thus, in a preferred eight print head embodiment of the carriage assembly 32 the print heads 50 disposed on a common side of the carriage 32 are spaced apart from each adjacent print head 50 by two inches (2") axially and 0.23" laterally. Furthermore, as can be seen in FIG. 5, the print heads 50 are disposed spaced from one another circumferentially, so that each print head 50 maintains a common distance from the exterior surface of drum 26 which is of course cylindrical. In one embodiment, each print head 50 is spaced from the next adjacent print head 50 by ten (10) degrees.

Referring to FIG. 5, with respect to the mounting surface 58, the print heads 50 are disengageably mounted onto their respective mounting location with a simple and effective three point retaining coupling 60. Three point retaining coupling 60 consists of two foot members 62 for receiving the corresponding two feet of a family of thermal ink jet cartridges manufactured by Hewlett-Packard, and known as model 51626A, and its higher resolution brethren using the same external bosses and mounting feet. The third point of attachment comprises a ball bearing 64 disposed in either a blind aperture or a cylindrical aperture 66 sealed at one end with a spring-loaded 65 ball bearing which protrudes slightly to releasably engage an upper surface of the noted print heads. The inventors have discovered that such an engagement mechanism provides a stable and repeatable means of attachment without further adjustment or manual tightening by an end user. Furthermore, the inventors have further discovered that such a design offers economy of space since nothing protrudes beyond the outer surface of the cartridge 50 itself while mounted for printing operations. For reference, many prior art cartridge attachment means rely upon relatively more complicated and less robust designs to typically mount cartridge 50 so that a plurality of ink jetting nozzles (not shown) associated therewith are oriented orthogonal to the axial movement of a reciprocating print carriage operating in a roll-fed large format digital print engine. In these prior art designs no premium is placed on space used for mounting the print cartridges 50 since there is virtually no limit to the available space for such mounting two pegs 68.

Figure 6:
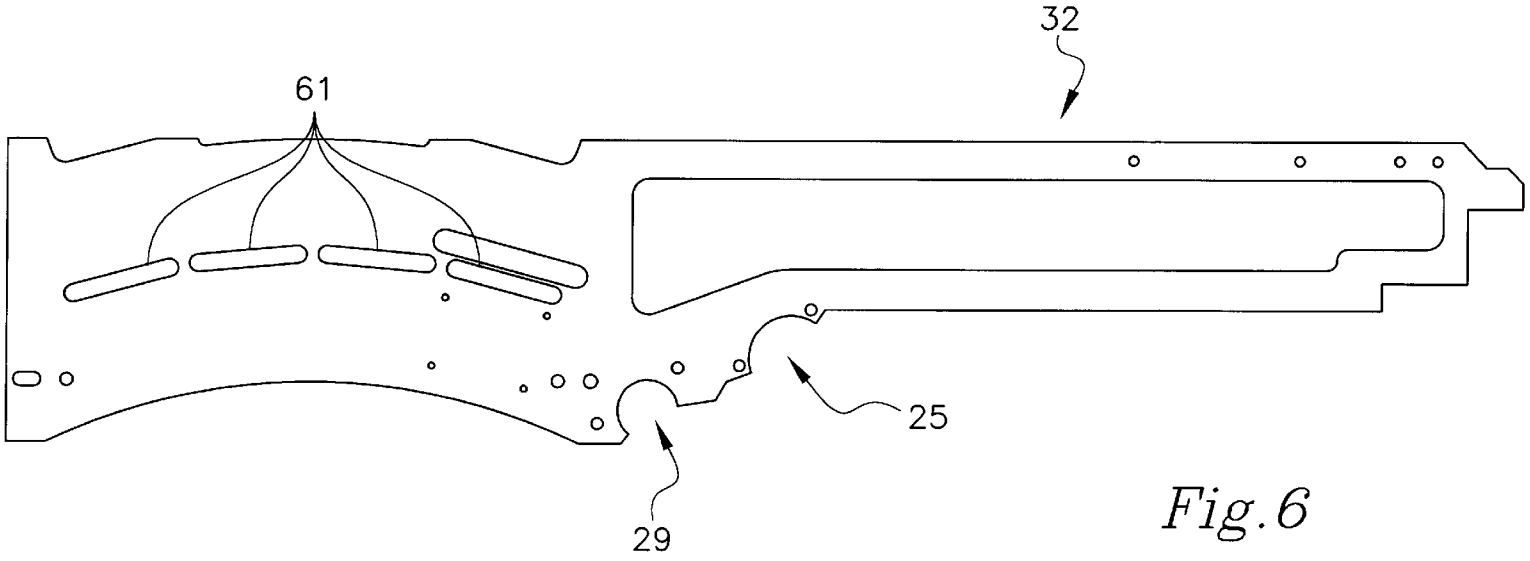
FIG. 6 is an elevational side view of an opposing lateral side of an embodiment of the carriage assembly of FIG. 5, mainly illustrating the four apertures for receiving a segment of flex cabling in the distal end of the assembly.

Referring to FIG. 6, which is also an elevational view in partial cross section along lines 5—5 of FIG. 4, of the full length of carriage assembly 32 apertures 70 formed in first carriage assembly structural member 76, admit electrically conducing flex circuit 72 to each of the print heads 50 at a first, end and a second end terminates at circuit board 74 disposed intermediate the two carriage assembly structural members 76,78 which is retained and partially inserted into a spacer member 80 disposed to space members 76 from 78 one from the other and provides a heat sinking effect to the circuit board 74 to dissipate heat therefrom.

Figure 7A:
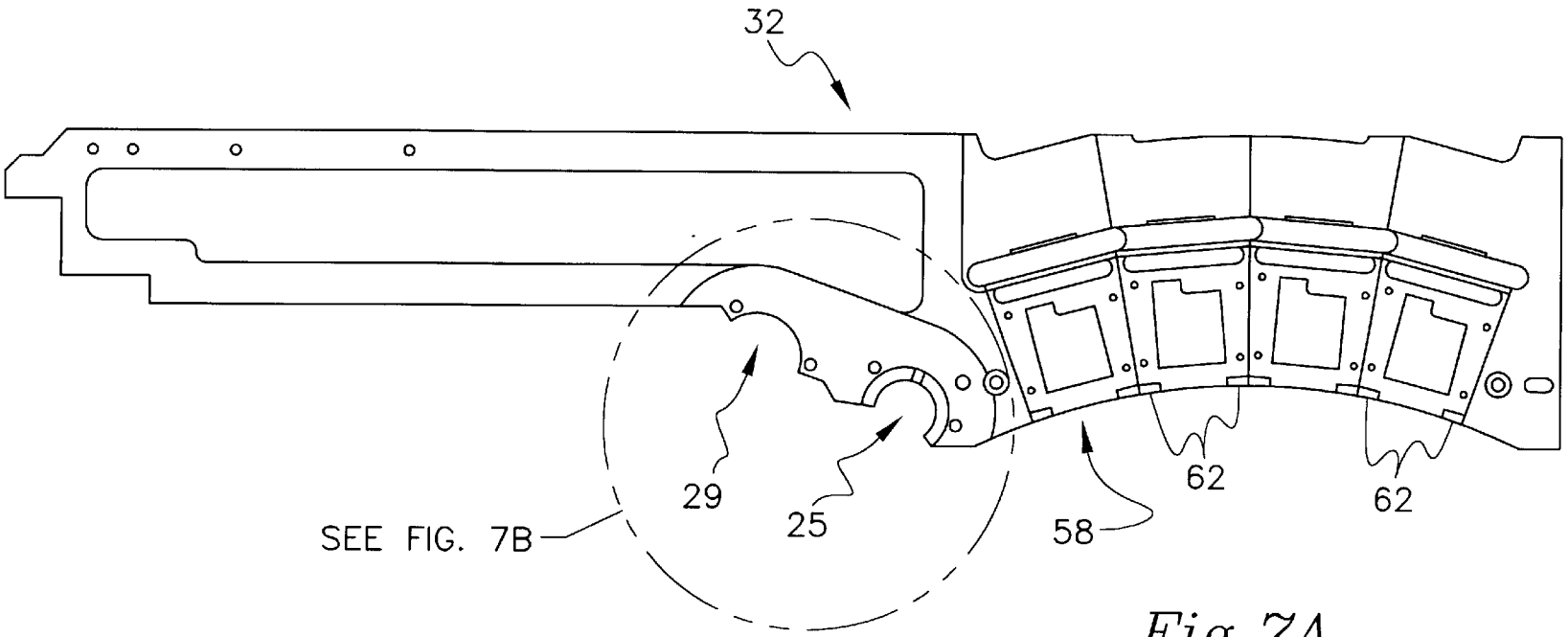
FIGS. 7A and 7B are both elevational side views in cross-section of a lateral side of an embodiment of the carriage assembly depicted in FIGS. 5 and 6, showing details of the coupling points for the carriage to a slide rail and a driven lead screw in one embodiment of the present invention.
Figure 7B:
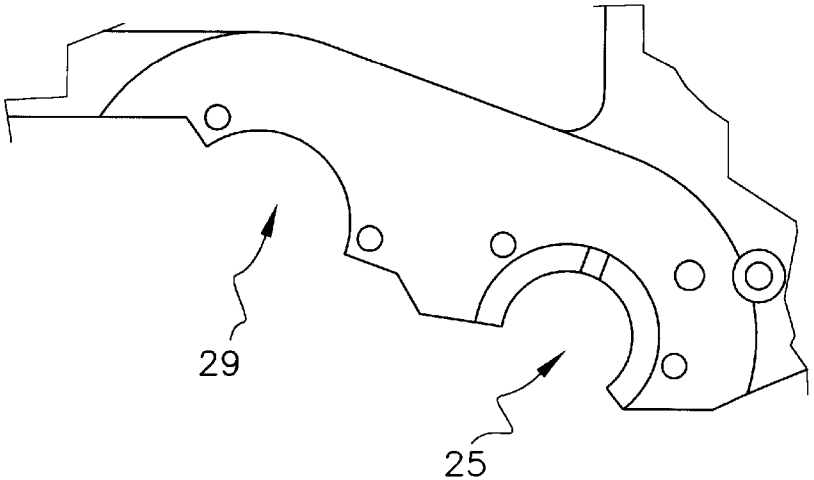
Figure 8A:
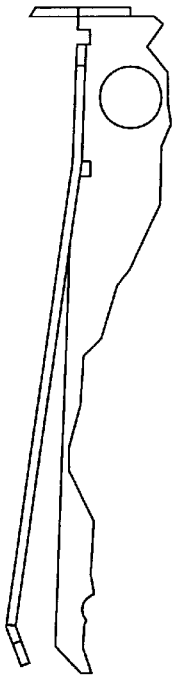
FIGS. 8A, 8B, and 8C depict a perspective view, two elevational side views, respectively, of a first dual function print cartridge attachment apparatus usable with the present invention, so that when attached to the carriage assembly, it retain a segment of flex cabling that connects each cartridge with print control circuitry and biases each print cartridge for optimal positioning accuracy.
Figure 8B:
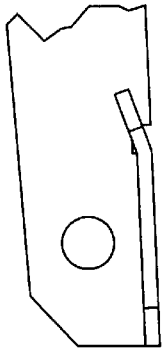
Figure 8C:
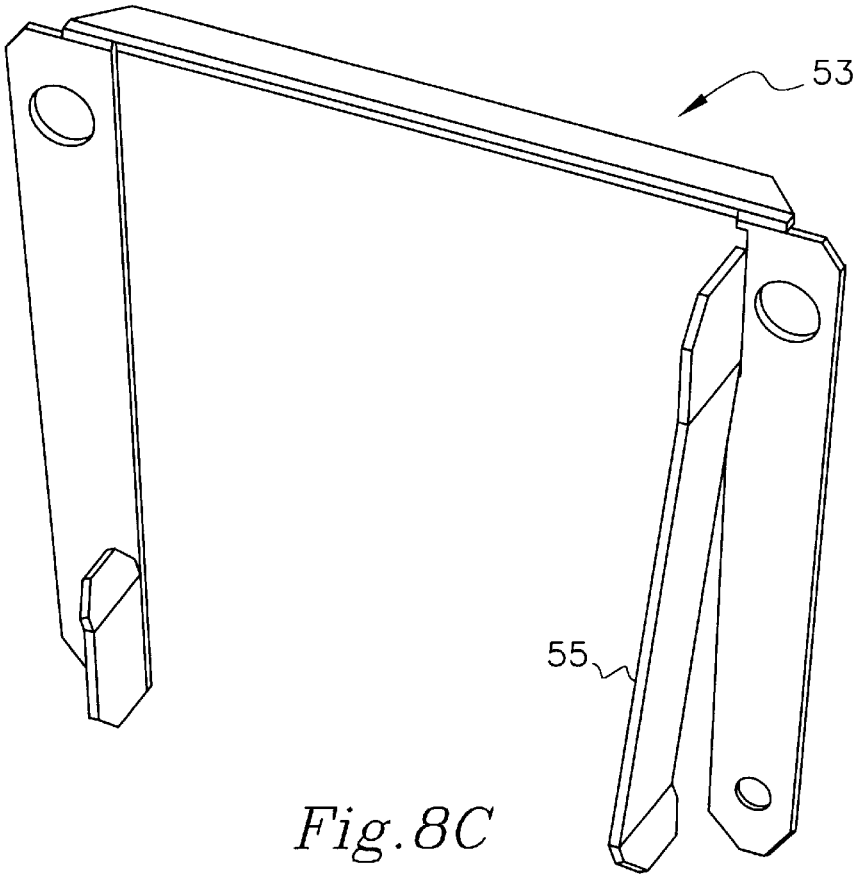
Figure 9:
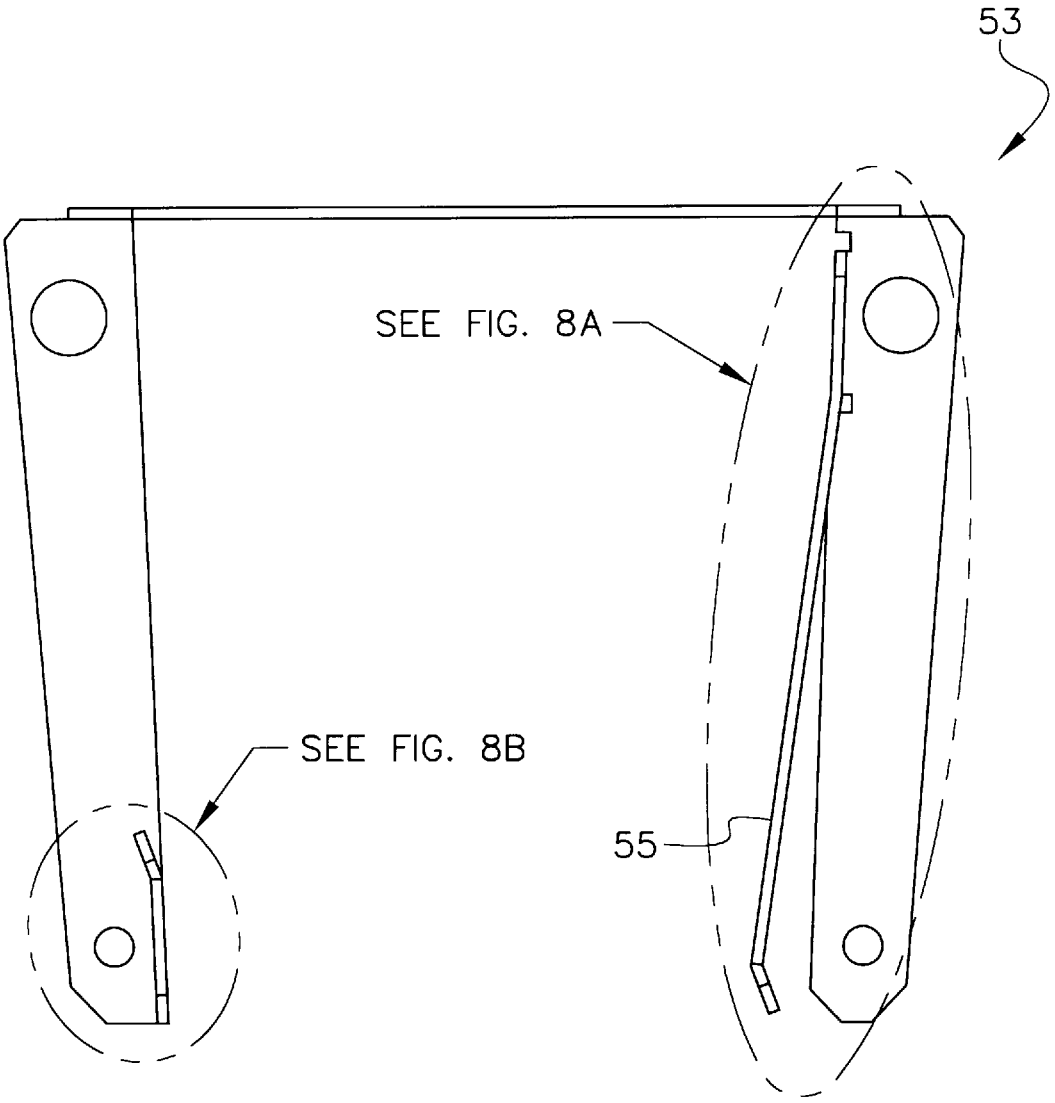
FIG. 9 is a plan view of the dual function print cartridge attachment apparatus of FIG. 8.

Referring to FIGS. 7A and 7B, the coupling of carriage assembly 32 to lead screw 28 is illustrated, first in an elevational view and second, in a perspective view of an embodiment of the actuator 30 which operates to drive carriage assembly 32 axially along the shaft rail 24.

Figure 11:
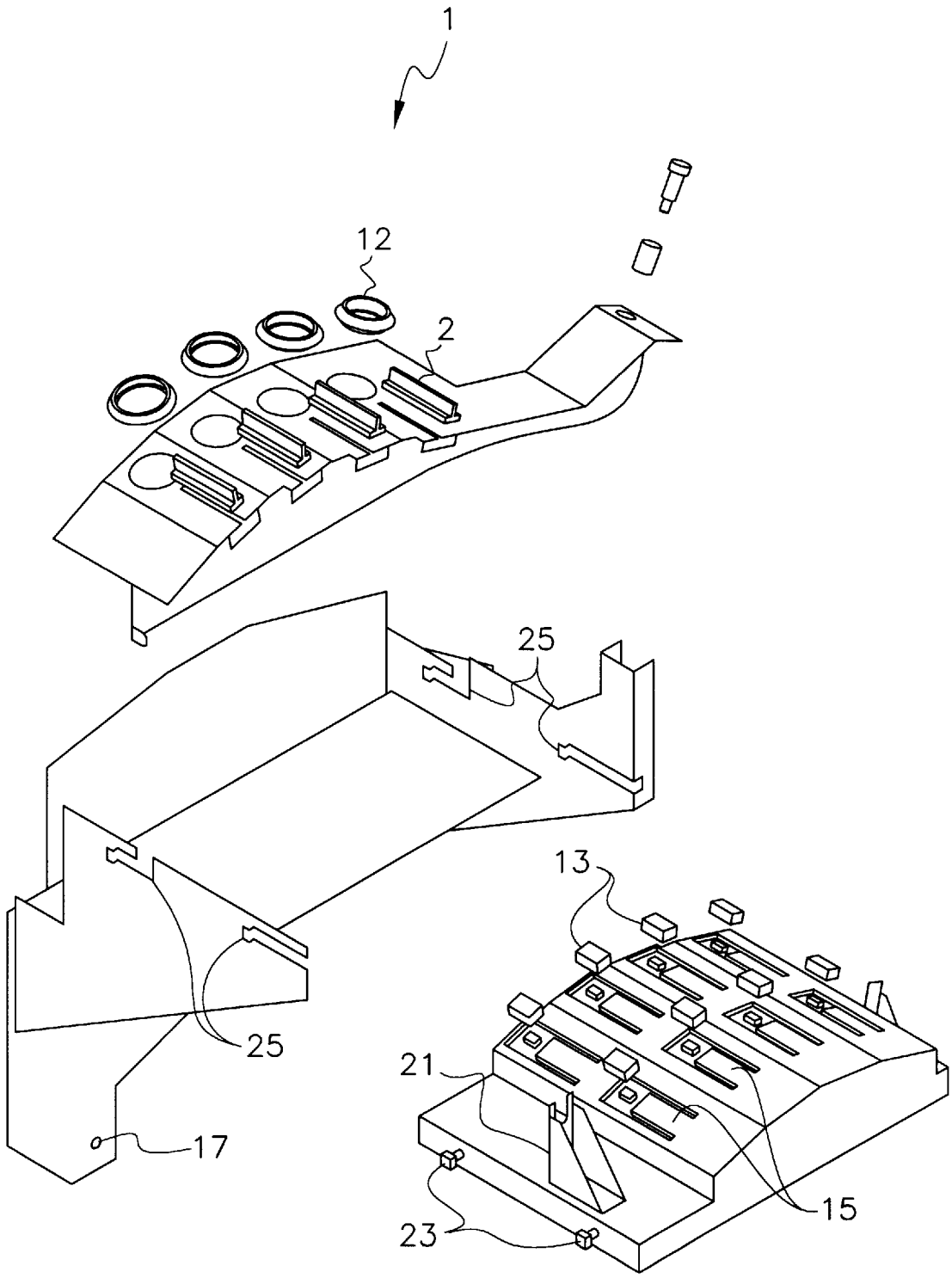
FIG. 11 is an exploded perspective view of a print cartridge service station sub-assembly usable with the present invention.

A spring loaded cartridge maintenance location, or "service station," is disposed at one end of the rail operates to perform capping and cleaning functions to the ink emitting nozzles of the cartridges so they perform within specification. The service station was designed without a minimum of moving parts, and is actuated by passively receiving a boss-shaped datum located at a distal end of the carriage assembly, thereby further promoting field service efficiency and precision alignment with a minimum of critical alignments. With reference to FIG. 11, depicting an exploded view of an embodiment of the service station having three main subcomponents: a frame 3, a spitting and wiping unit 4, and a capping unit 5 having a cantilevered arm bearing a resin cap for sealing each group of nozzles of each cartridge as is known in the art. In operation, however, frame member 3 is resiliently fixed to at least two datum points extending from a critical alignment plate thereby ensuring a proper vertical alignment with the cartridges riding on the carriage assembly. When installed, allowance for unobstructed space above frame 3 ensures that unit 4 can articulate to receive ink from and wipe the nozzles. The frame 3 thus mechanically couples to spitting and wiping unit 4 which articulates on a parallel axis to the axis of lead screw 28 so that after momentarily aligning an ink receiving vessel with the ink emitting nozzles of each row of print cartridges, the unit 4 reciprocates so that a short segment of wiper armature clears ink from the surface of the nozzles. To achieve this movement with a minimum of additional components, a single solenoid actuator first attracts the unit 4 while the carriage controllably aligns with a first row of cartridges, then the solenoid releases and a spring member biased against the solenoid actuator, propels the unit 4 in a second wiping pass of the nozzles. The carriage assembly thus must reverse direction briefly so that the second row of cartridges receive the same treatment as the first row of cartridges. Inherent in this design, a variety of experimental spring force measurements that apply to wiping 4 cartridges at once with a ¼" tall wiper helped the inventors arrive at the present embodiment. Then, the carriage preferably translates laterally until it engages a tab member on the capping unit 5 which then translates laterally in concert with the carriage and at the same four pivot mounting members encounter a vertically rising engagement surface thus forcing unit 5 upward into sealed engagement with the nozzles of each print cartridge, where they remain prepared until a next required printing operation or for manual replacement with a different set of marking materials by the operator. In designing the service station of the present invention, the inventors consulted and considered, among other things, capping station pressures, evaporation rates, and other criteria for designing the capping station, including psychometric chart (used in evaporation calculations), and tolerance stack-up allocation for components.)

In another embodiment of the service station, a capping member made of a foam pad is used in lieu of the capping boot described and illustrated above. In the prior art, foam pads of this type were used in addition to vacuum removal of ink from the nozzles of the cartridge. The inventors believe that simply by adding a suitable biocide to the foam pad, unwanted contamination and/or growth of organisms can be alleviated and no further modification to this low cost passively operated service station.

Furthermore, basic concerns regarding maximizing the number of non-critical alignments led the inventors to design every component of the present invention so as to minimize tolerance stack-up. For example, even a workpiece such as the capping station 5 that possess compound curvatures and cooperating portions have been integrated, to the extent possible, so that only a single step generates a final piece from a raw or semi-raw condition. In this way, the number of misalignments are decreased since the opportunity to create differing mounting and cooperating features during fabrication of the components of the present invention. At its most basic this procedure manifests itself when a part fabrication is mounted more than one for finishing work and thus every different mounting of the part during fabrication can, and typically will, contribute to the overall error of any part, and especially three dimensional parts, such as capping station 5.

In one embodiment of the present service station, a split sensor oriented so that an integral extension to the carriage trips the split sensor, and thereby indicates an absolute location of the carriage assembly. This sensor provides the location to carriage control circuitry so that the drive screw may operate in reverse briefly during each service station visit by the carriage. As can be appreciated, the print engine of the present invention operates independently of absolute carriage and print head position sensing or calculation. As a result this split sensor provides a location signal of adequate resolution for the accurate control of the carriage during a service station visit.

Figure 10A:
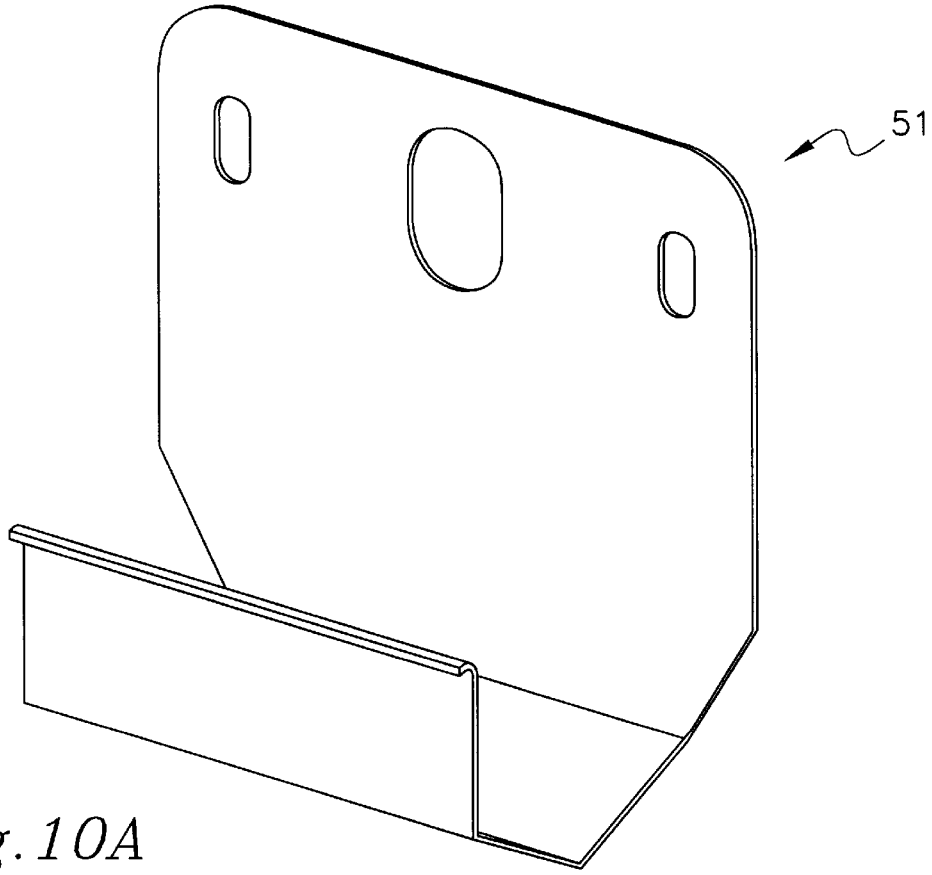
FIGS. 10A and 10B is a perspective view and a plan view, respectively, of a second print cartridge attachment apparatus for use with the first attachment apparatus of FIGS. 8 and 9 to generate an x- and y-component of force to a print cartridge.
Figure 10B:
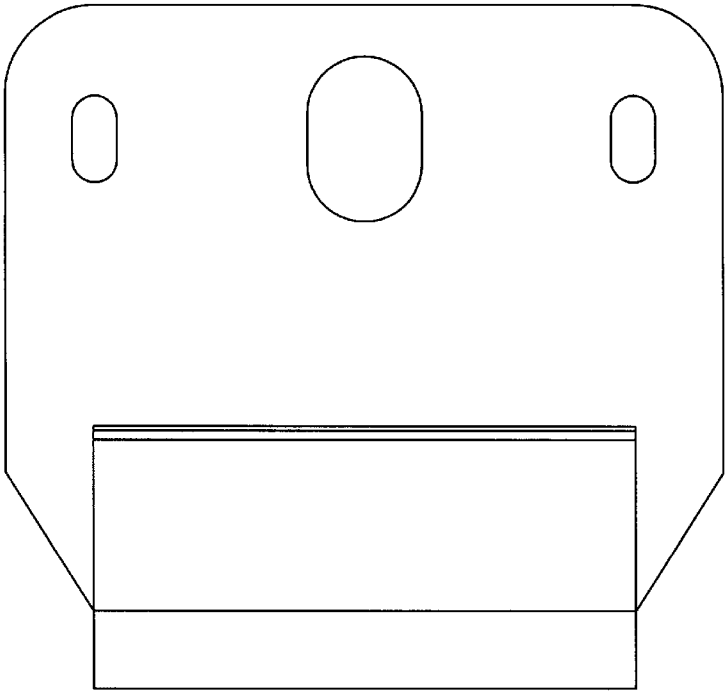

In an alternative embodiment depicted in FIG. 10, the means for attachment of the cartridge includes a first leaf spring 51 formed of sheet stainless steel and bent in at least two places to create a laterally compact gripping force with components in both the x-direction and the y-direction. Otherwise, this embodiment of a portion of the attachment means otherwise serves the same purpose of the ball bearing detent taught above; namely; to bias the cartridge against a mechanical datum, or point of known dimension within a workpiece, so that the cartridge assumes a known orientation on the carriage. Similarly, a second attachment means 53 provides at least dual mechanical functions. First, flex cable 68 which is preferably clamped to the carriage assembly by means 53 such that in cooperation with at least two posts 58,68 precisely located on opposing sides of the ultimate location of the cartridge the flex cable it possesses known points of attachment for establishing electrical between more than forty (40) discrete electrical terminals at one time. Second, a portion 55 of means 53 provides a biasing force so that cartridge positively engages a chosen mechanical datum. Preferably, relatively the same datum point is utilized for each attachment means on the carriage assembly. In a preferred embodiment Hewlett-Packard cartridge model #51626A, and cartridges of similar dimension, constructed to emphasize one or more datums for exact positioning on a carriage assembly are used in practicing the present invention. This embodiment offers an extremely accurate and repeatable location, while at the same time a laterally compact profile, to the attachment of replaceable cartridge. Thus, for an eight cartridge wide format ink jet printer where the cartridge are arranged in rows of two or more cartridges, when precisely aligned will print only adjacent print swaths, so that no overlap occurs, thereby promoting the even evaporation and assimilation of the ink.

Figure 16:
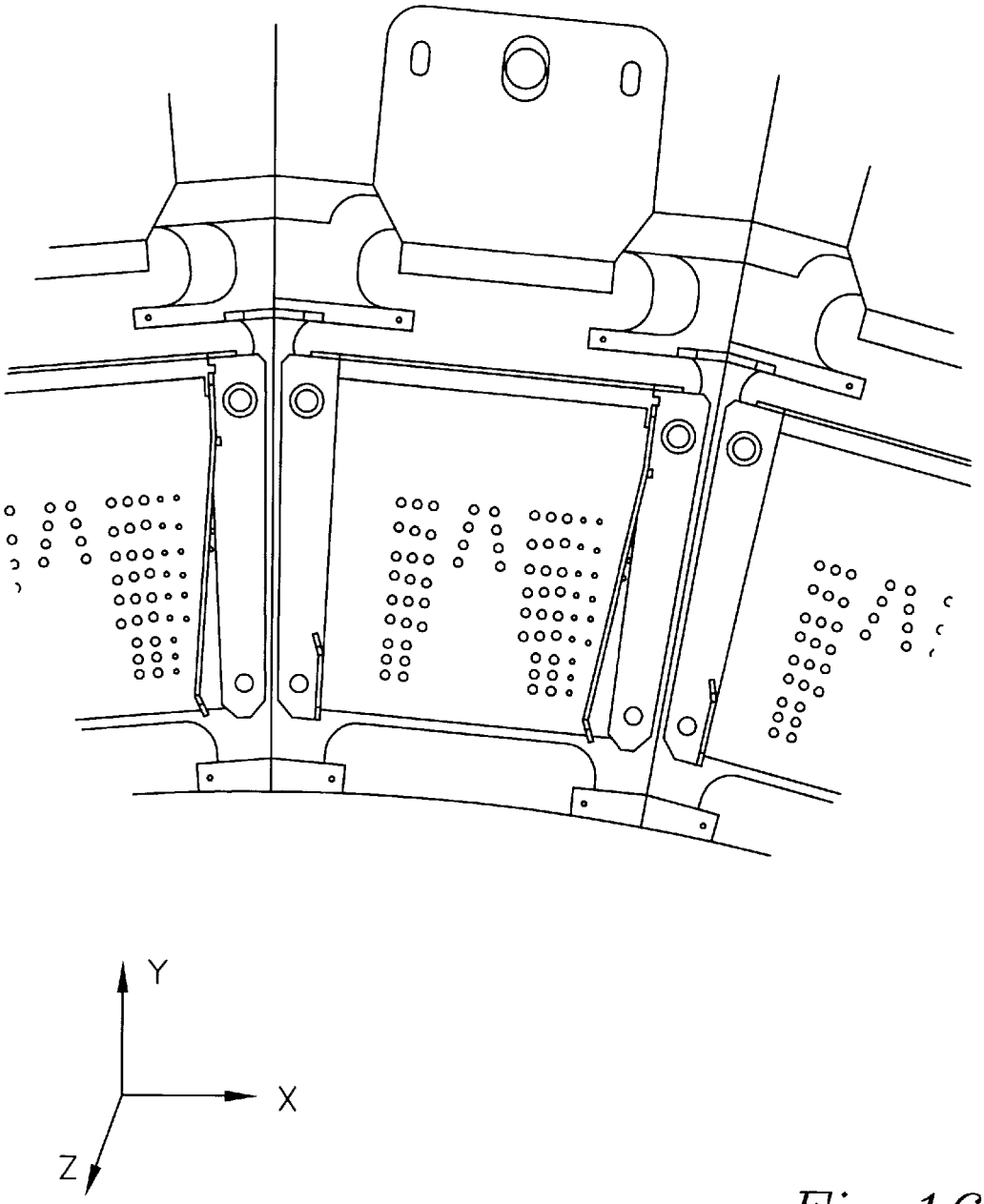
FIG. 16 is an enlarged elevational side view of a cartridge attachment location on the carriage assembly and illustrates the plurality of mounting locations and at least two spring mounting surfaces of a preferred mounting arrangement of the present invention.

The ink cartridge is precisely located relative the electrical contacts on the flex cable in three axis using eight locating surfaces and two springs. As shown in FIG. 16 there are two mounting surfaces in the "x" direction, four mounting surfaces in the "z" direction, and two mounting surfaces in the "y" direction. The ink cartridge is preloaded up against these eight surfaces using two springs. As shown a side leaf spring is used to bias the cartridge against the "x" direction mounting surfaces. Also as shown, a top spring, shown as a leafsping in this figure, is used to bias the ink cartridge down against the "y" mounting surfaces and back against the "z" direction mounting surfaces.

The enclosure 40 of the present inventive print engine is compartmentalized for maximum field service efficiency and isolation of subassemblies one from the other, while at the same time decreasing unwanted vibration of above twenty five (25) hertz. In a first semi-enclosed space within the enclosure a suitable electrical source of power couples to a power supply so that a twenty-four (24) volt and a nine (9) volt rail are supported for operating the various, subassemblies of the print engine. The microprocessor and associated memory, input/output coupling, electrical traces, and at least one cooling fan are all located in this space of the enclosure. Unlike many prior art print engines, the present engine "operating system electronics," are all spaced apart from the print engine "imaging electronics" which preferably reside intermediate the rows of cartridges on the carriage assembly, and are thermally coupled to a heat sink member also disposed intermediate the two rows of carriage assembly attachment means. As a result of this feature, an extremely high rate of image data throughput is supported so that higher speed and more complex print modes may be reliably operated. Furthermore, in this embodiment when the at least one cooling fan operates it of course provides fresh air to promote even thermal distribution among the electrical components residing in the immediate space; however, this space is fluidly coupled to a plenum which ports the flow of air to a second space containing the rotating drum. Thus, when the fan is operating, and an access panel to the rotating drum is closed, the air first interacts with the electronics and is warmed slightly before entering the printing enclosure and providing a slight increased pressure and turbulent air flow to keep any airborne contaminants from settling in the printing chamber and to promote ink drying after being deposited on the printing medium by the cartridges. Another advantage to the interior cooling and ventilation of the print engine relates to what the inventors perceive as an increased amount of ink that may be applied to a single printed image, thereby allowing modes of printing previously unattainable.

In another aspect of an embodiment of the print engine enclosure of the present invention, at least one window or viewing port in a side of the enclosure permits viewing of the rotating drum, and an image being deposited on an media attached thereto, so that an operator may closely monitor performance and progress of each printing episode. In one adaptation of this embodiment, at least one stroboscopic light or other pulsing light source, disposed within the printing space illuminates a portion of the surface of the rotating drum so that if coupled to a suitable clocking signal source, such as either of the rotary encoders attached to the drum or the lead screw, the image will be briefly illuminated so that the operator may view a relatively fixed portion of the image as can be appreciated with reference to known stroboscopic effects.

A preferred method of manufacture of a drum member usable with the present print engine is detailed in the application referred to above. The reader is encourage to review the disclosure therein for a fuller understanding of the design considerations and criteria for the present drum member. A current embodiment of a drum subassembly useable with the present invention basically consists of a resin-based, or plastic, sleeve bonded to two endcaps with total indicated run-out ("TIR") of not more than 0.005" over the entire surface of the drum, and a static balance of not greater than 0.8 inch lbs, and a diameter of the drum or 15.900"+/−0.005" and a width of 36.25"+0.040"−0.000" and a torque rating during printing operations one (1) inch ounce maximum.

Rotary encoder assembly preferably employs a one thousand (1000) counts per revolution optical chopper—a part customized for the print engine described herein although quite similar in some respects to Hewlett-Packard 6000 Series three channel optical encoder reader. Since these types of encoders are well known in the art, no further discussion of the encoder follows.

The drum is driven about its axis of rotation by a pulley subassembly coupled to a simple low torque electric motor residing in an enclosed space so that only a drive wheel protrudes into the printing space. The belt driven between the motor and a driving surface on an end of the drum preferably is a timing-type belt with geared teeth to reliably engage the drive wheel of the motor. In order to further control tolerance stacking and creep, a variety of drum drive belt stretch test data was captured so that a predictable amount of wear and stretching of the drive belt can be tolerated by the printing engine. Since the rotation of the drum and the drive screw are independently operated, and the precise control and stability of both directly impact the accuracy of the final printed output, very little stretch can be tolerated, and therefore the belts 45 have a recommended replacement frequency that ensures the desired quality of printing.

The drum member is preferably statically and dynamically balanced. First of all known static balancing techniques ensure that the drum is balanced at rest. Then the drum is rotated to a stable rotational velocity and torque measured at various periods of time. As is known in the art a plug of material is typically added so one or both lateral sides of the rotary drum member so that undesired vibration during rotation is eliminated.

While the present invention has been described with reference to certain embodiments, it is clear to one of skill in the art that various other embodiments and changes of form shall are covered by the spirit of the invention and as such shall be considered part of the invention as particularly claimed in the following claims, which alone define the metes and bounds of the invention herein disclosed, enabled, and taught.

What is claimed is:

1. A drum-based digital print engine, comprising:

a frame member;

a first critical alignment plate and a second critical alignment plate precisely aligned with the frame member and connected thereto;

a lead screw, a first support rail, and a second support rail attached to the first and the second critical alignment plate;

a lead screw drive motor mechanically coupled to drive the lead screw about an axis of rotation of the lead screw;

a carriage assembly having a mechanically cooperating member attached to the lead screw and another location in slideable contact with the first and second support rails, and constructed to carry print head driver circuitry to print head attachment locations distributed along opposing sides of the carriage assembly;

a plurality of print heads mechanically and electrically coupled the carriage assembly;

a drum member coupled to the first and second alignment plates and proximately disposed near the first support rail;

a drum member motor mechanically coupled to the drum member;

a first optical encoder coupled to the drum member for providing an electrical signal of rotation to a print control circuit;

print control circuitry for receiving a digital file of an image to be printed and conveying the image to be printed to the print head driver circuitry carried by the carriage assembly so that the plurality of print heads emit ink during rotation of the drum member so that an image is formed;

wherein the printing cartridges are coupled to the carriage assembly with a dual function leaf spring-clip that retains a flex circuit that conveys electrical nozzle firing signals from the print head drive circuit to a cartridge and biases a cartridge to a cartridge mounting datum and a leaf spring simultaneously biases the cartridge in the x and y direction so that the cartridge is resiliently but replaceably mounted to the carriage assembly.

2. The print engine of claim 1, wherein the plurality of print heads is eight print heads and each of the eight print heads are disposed with respect to each other print head so that each print head prints upon a different swath of a printing medium attached to the drum member at any one instant of time.

3. The print engine of claim 1, wherein a ratio of rotation of the lead screw to the rotation of the drum member is 2:1.

4. A drum-based digital print engine, comprising:

a frame member;

a first alignment plate and a second alignment plate precisely aligned with the frame member and mechanically fastened thereto;

a lead screw, a first support rail, and a second support rail mechanically coupled to the first and the second critical alignment plate;

a lead screw drive motor mechanically coupled to drive the lead screw about an axis of rotation of the lead screw;

a carriage assembly having a mechanically cooperating member attached to the lead screw and another location in slideable contact with the first support rail and the second support rail, and constructed to carry print head driver circuitry to print head attachment locations distributed along opposing sides of the carriage assembly;

a drum member coupled to the first and second alignment plates and proximately disposed near the first support rail;

a drum member motor mechanically coupled to the drum member;

a first optical encoder coupled to the drum member for providing an electrical signal of rotation to a print control circuit;

print control circuitry for receiving a digital file of an image to be printed and conveying the image to be printed to the print head driver circuitry carried by the carriage assembly so that the plurality of print heads emit ink during rotation of the drum member so that an image is formed;

wherein a first leaf spring-clip retains a flex circuit that conveys electrical nozzle firing signals from the print head drive circuit to a cartridge receiving socket and also biases a cartridge to a cartridge mounting datum and a second leaf spring simultaneously biases the cartridge in the x and y direction so that the cartridge is resiliently but replaceably mounted to the carriage assembly.

5. The print engine of claim 4, wherein the cartridge receiving socket comprises at least six cartridge receiving sockets.

6. The print engine of claim 4, wherein a ratio of rotation of the lead screw to the rotation of the drum member is 2:1.

* * * * *